US007448339B2

(12) United States Patent
Bruengger et al.

(10) Patent No.: US 7,448,339 B2
(45) Date of Patent: Nov. 11, 2008

(54) WINGED BODY HAVING A STOWED CONFIGURATION AND A DEPLOYED CONFIGURATION

(75) Inventors: Craig V. Bruengger, Norwell, MA (US); Todd E. Southard, Cambridge, MA (US)

(73) Assignee: Ultra Electronics Ocean Systems, Inc., Braintree, MA (US)

( * ) Notice: Subject to any disclaimer, the term of this patent is extended or adjusted under 35 U.S.C. 154(b) by 0 days.

(21) Appl. No.: 11/613,426

(22) Filed: Dec. 20, 2006

(65) Prior Publication Data

US 2008/0250998 A1 Oct. 16, 2008

(51) Int. Cl.
*B63B 21/66* (2006.01)

(52) U.S. Cl. ..... 114/244

(58) Field of Classification Search ..... 114/312, 114/313, 316, 326–329, 244, 245; 244/3.29
See application file for complete search history.

(56) References Cited

U.S. PATENT DOCUMENTS

| | | | | |
|---|---|---|---|---|
| 3,103,886 | A * | 9/1963 | Popenoe | 244/3.29 |
| 4,736,908 | A * | 4/1988 | Boder | 244/3.29 |
| 5,480,111 | A * | 1/1996 | Smith et al. | 244/3.27 |
| 7,090,163 | B2 * | 8/2006 | Rastegar et al. | 244/3.28 |

* cited by examiner

*Primary Examiner*—Ed Swinehart
(74) *Attorney, Agent, or Firm*—Daly, Crowley, Mofford & Durkee, LLP

(57) ABSTRACT

A winged body has a wing structure with at least two wings coupled to a body structure, each wing having a wing tip. The wings wrap around the body structure when in a stowed configuration within a launch tube, and the wings spring outward from the body structure to a deployed configuration when the winged body is removed from the launch tube. The wings can take deformed-deployed configurations when the winged body is towed at a relatively high speed through the water.

23 Claims, 5 Drawing Sheets

WINGED BODY HAVING A STOWED CONFIGURATION AND A DEPLOYED CONFIGURATION

FIELD OF THE INVENTION

This invention relates generally to winged bodies and, more particularly, to a winged body having elastically deformable wings with a towed configuration and a deployed configuration.

BACKGROUND OF THE INVENTION

As is known, a conventional submarine includes a variety of launch tubes, which are used to launch a variety of devices from the submarine, including, but not limited to, torpedoes, countermeasure devices, and communication devices. Some of these devices, in particular, some communication devices, remain tethered to the submarine during operation.

There is a desire to launch tethered devices from the submarine while the submarine is moving. When tethered to the moving submarine, the tethered devices face potential damage from being drawn into the submarine propeller.

SUMMARY OF THE INVENTION

In accordance with one aspect of the present invention, a winged body includes a body structure having a length and a circumference. The winged body also includes a wing structure coupled to the body structure, wherein the wing structure is comprised of at least two wings. Each wing has a respective wing tip. The wings have a deployed configuration and a stowed configuration, wherein the wings are elastically deformable to the stowed configuration from the deployed configuration, and wherein the wings are elastically releasable from the stowed configuration to the deployed configuration. The wings in the deployed configuration have respective shapes selected to provide a lift upon the body structure when pulled though water. The wings in the stowed configuration have respective shapes selected to wrap generally around at least a portion of the circumference of the body structure.

In accordance with another aspect of the present invention, a winged body includes a body structure having a length and a circumference. The winged body also includes a wing structure coupled to the body structure, wherein the wing structure is comprised of at least two wings. Each wing has a respective wing tip. The wings have a deployed configuration and a stowed configuration, wherein the wings are elastically deformable to the stowed configuration from the deployed configuration, and wherein the wings are elastically releasable from the stowed configuration to the deployed configuration. The wings in the deployed configuration have respective shapes selected to provide a lift upon the body structure when pulled though water. The wings in the stowed configuration have respective shapes selected to wrap generally around at least a portion of the circumference of the body structure. The winged body further includes a retention mechanism adapted to hold the wings in the stowed configuration, and further adapted to release the wings from the stowed configuration to the deployed configuration. Each one of the wings includes a feature. The retention mechanism includes a lace coupled to the feature of each one of the wings. The lace is adapted to hold the feature of each one of the wings at a predetermined relative separation, resulting in the wings being retained in the stowed configuration. The lace is adapted to hold the wings in the stowed configuration when the winged body is within a tube, and the lace is adapted to release the wings from the stowed configuration to the deployed configuration when the winged body is removed from the tube. The winged body still further includes a tail structure coupled to the body structure, wherein the tail structure has a deployed configuration and a stowed configuration, wherein the tail structure is elastically deformable to the stowed configuration from the deployed configuration, and wherein the tail structure is elastically releasable from the stowed configuration to the deployed configuration. The tail structure in the deployed configuration has as shape selected to provide a stability to the body structure when pulled though water. The tail structure in the stowed configuration has a shape selected to wrap generally around at least a portion of the circumference of the body structure.

BRIEF DESCRIPTION OF THE DRAWINGS

The foregoing features of the invention, as well as the invention itself may be more fully understood from the following detailed description of the drawings, in which.

DETAILED DESCRIPTION OF THE INVENTION

Figure 1:
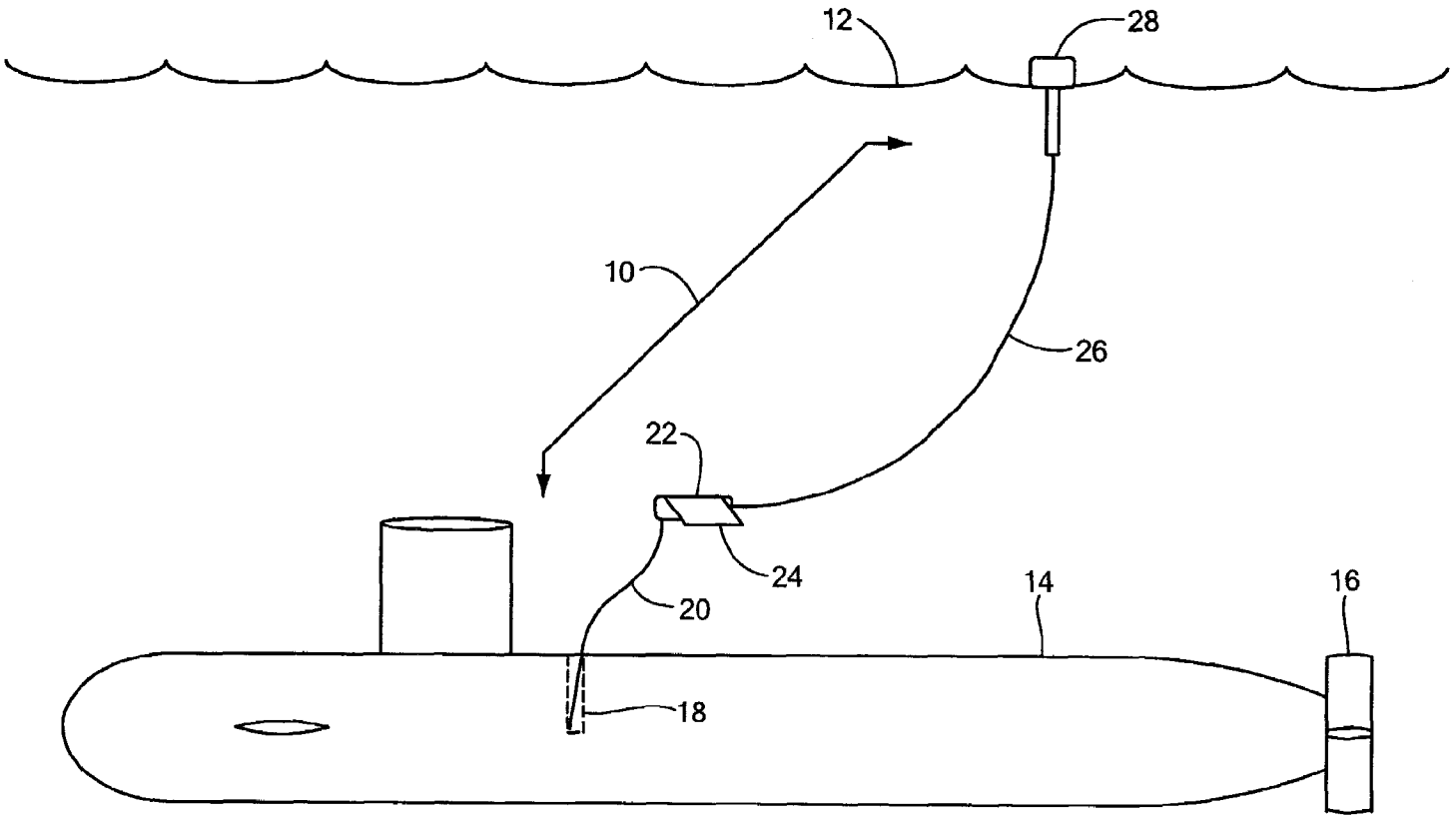
FIG. 1 is a pictorial showing a submarine system having a winged body in accordance with the present invention.

Referring to FIG. 1, an exemplary system 10, can be deployed from a submarine 14 while traveling (or while stationary) in the water 12. The submarine 14 includes a propeller 16 and a launch tube 18.

While the system 10 is shown to be deployed from a submarine, the system 10 can be used in conjunction with any water-born platform, including, but not limited to, a surface ship, an underwater autonomous vehicle (UAV), a stationary water platform, or a moving water platform.

It will be appreciated that a conventional submarine includes a variety of launch tubes, which are used to launch a variety of devices from the submarine, including, but not limited to, torpedoes, countermeasure devices, and communication devices. Some of these devices, in particular, some communication devices, remain tethered to the submarine during operation.

The system 10, shown in a deployed configuration, can include a tether line 20 (also referred to herein as a tow cable) having a communication link therein, for example, a wire link or a fiber optic link. The system 10 can also include a winged body 22 having at least two wings 24, a communication link 26, for example, a fiber-optic cable, which can be coupled to the communication link associated with the tether line 20, and a surface float 26 having an antenna therein (not shown). In some arrangements, the surface float 26 is inflatable during deploying of the system 10.

In a stowed configuration (not shown) the tether line 20, the winged body 22, the fiber optic link 26, and the surface float 28 are stowed within the launch tube 18. The stowed configuration is described below in greater detail in conjunction with FIGS. 2, 2A, and 3.

In operation, a communication signal transmitted or received by communication equipment (not shown) within the submarine 18 travels through the communication link within the tether line 20, through the communication link 26, and couples to the surface float 26. A radio transmitter (not shown) and/or radio receiver (not shown) within the surface float 26 can transmit and/or receive a radio frequency (RF) signal to/from a satellite receiver, aircraft receiver, or land receiver.

During deployment of the system 10 from the launch tube 18 while the submarine is traveling through the water 12, and also during operation of the system 10 while the submarine 14 is traveling through the water 12, the system 10 is held upward away from the propeller 16 by an upward lift provided by the winged body 22. The wings 24 of the winged body 22 can provide the lift as a kite. However, in some embodiments, the wings can also have respective contours that provide the lift by Bernoulli's principle, like airplane wings.

Since the launch tube 18 can have a relatively small diameter, for example, three inches, the wings 24 may not fit within the launch tube 18. Therefore, it may be necessary to retain the wings 24 in a stowed configuration while the system 10 is in the launch tube 18 and to release the wings 24 to a deployed configuration when the system 10 is launched from the submarine 14.

Figure 2:
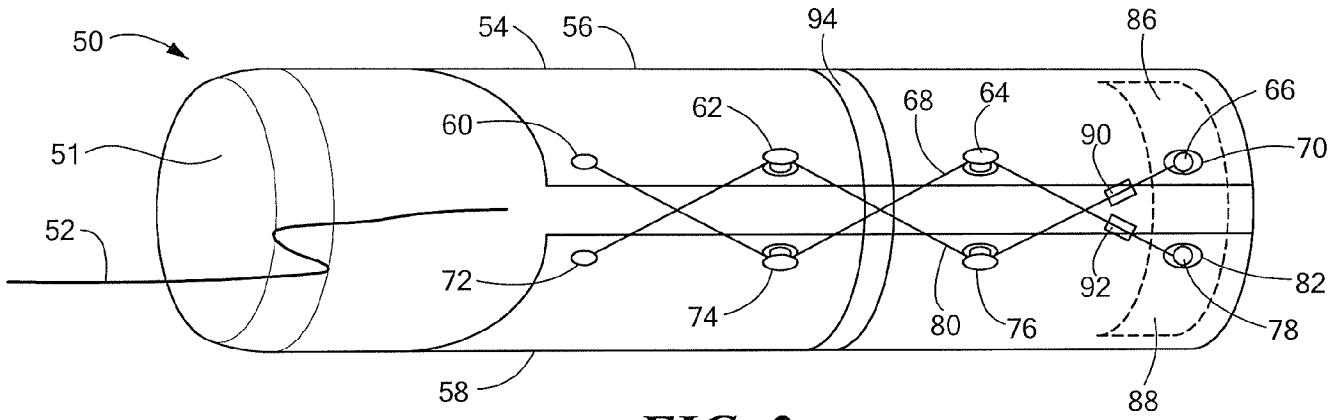
FIG. 2 is a pictorial showing the winged body of FIG. 1 in a stowed configuration.

Referring now to FIG. 2, a winged body 50 (also referred to herein as a tow body) includes a body structure 11 having a length and a circumference. The winged body 50 also includes a wing structure 54 coupled to the body structure 51. The wing structure 54 includes at least two wings 56, 58, each wing having a respective wing tip shown below in FIG. 4. The wings 56, 58 are shown in a stowed configuration. The wings 56, 58 are elastically deformable to the stowed configuration from a deployed configuration described more fully below in conjunction with FIGS. 4 and 5. The wings are elastically releasable from the stowed configuration shown to the deployed configuration. It will be apparent from the discussion below in conjunction with FIG. 5 that the wings 56, 58 in the deployed configuration have respective shapes selected to provide a lift upon the body structure when pulled though water. The wings 56, 58 in the stowed configuration shown have respective shapes selected to wrap generally around at least a portion of the circumference of the body structure 51.

The winged body 50 CAN also include a retention mechanism adapted to hold the wings 56, 58 in the stowed configuration, i.e., wrapped around the body structure 51. The retention mechanism is further adapted to release the wings 56, 58 from the stowed configuration to the deployed configuration. In some embodiments, the retention mechanism can include one or more laces 68, 80, one or more features 62, 64, and one or more features 74, 80, described more fully below.

In some arrangements, the wing 56 can include two features 62, 64 and the wing 58 can include two features 74, 76. The retention mechanism can include two laces 68, 80, which, in the stowed configuration, are laced around the features 62, 64, 74, 76 of each one of the wings 56, 58. The laces are adapted to hold the features 62, 64 and 74, 78 of each one of the wings 56, 58 at a predetermined relative separation, resulting in the wings 56, 58 being retained in the stowed configuration. In other words, the laces 68, 80 retain the wings 56, 58 so that they remain generally wrapped about the body structure 51. In some other embodiments, each one of the wings 56, 58 can include more than two features or fewer than two features. In some embodiments, the retention mechanism can include more than two laces or fewer than two laces.

The two wings 56, 58 can include lace terminations 60, 72, respectively, which couple the laces 68, 80 to the wings 56, 58. The two wings 56, 58 can also include holes or indents 70, 82, respectively. The lace 80 can include a feature 66, e.g., a ball, adapted to fit in the hole or indent 70 and the lace 68 can include a feature 78 adapted to fit in the hole or indent 82. It will be apparent from FIG. 2A that the features 66, 78, can retain the laces in the position shown when the winged body 50 is within a launch tube, and can release the laces when the winged body is removed from the launch tube.

In some embodiments, the winged body 50 can also include a tail structure 84 coupled to the body structure 51. The tail structure 84 can have two tails 86, 88. Like the wings 56, 58, the tail structure 84 has a deployed configuration and a stowed configuration. The tail structure 84 is elastically deformable to the stowed configuration from the deployed configuration, and the tail structure 84 is elastically releasable from the stowed configuration to the deployed configuration. The tail structure 84 in the deployed configuration has a shape selected to provide a stability to the body structure 51 when pulled though water. The tail structure 84 in the stowed configuration has a shape selected to warp generally around at least a portion of the circumference of the body structure 51. The two configurations are further described below.

Figure 2A:
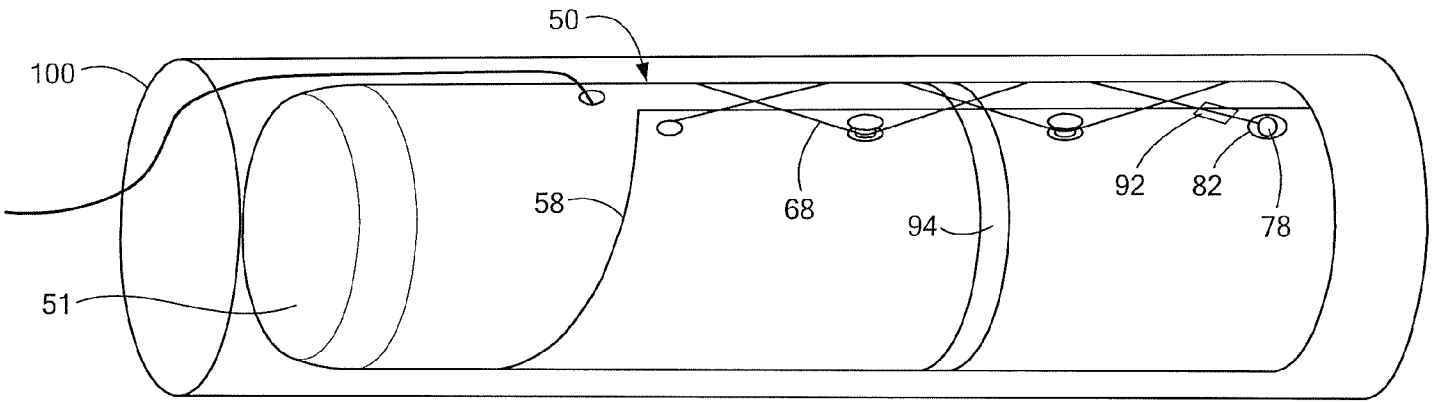
FIG. 2A is a pictorial showing the winged body of FIG. 1 in a stowed configuration within a tube, for example, a launch tube.

Referring now to FIG. 2A, in which like elements of FIG. 2 are shown having like reference designations, the winged body 50 is adapted to fit into a tube 100, for example a launch tube, the same as or similar to the launch tube 18 of FIG. 1. The feature 78 of the lace 68 contacts an inner surface of the tube 100, holding the feature 78 in the hole or indent 82 in the wing 58. Similarly, the feature 66 of the lace 80 contacts an inner surface of the tube 100, holding the feature 66 in the hole or indent 70 in the wing 56. Only when pulled from the tube 100 do the laces 68, 80 release the wings 56, 58 from the stowed configuration to the deployed configuration.

The wings 56, 58 and the tail structure 84 are comprised of a spring material, for example a spring steel or a spring plastic.

In some embodiments, there is no retention mechanism (i.e., features 62, 64, 74, 80 and laces 68, 80), and the wings 54, 56 and tail structure 84 are held in the stowed configuration only by contact with the inners surface of the tube 100. In some other embodiments, pyrotechnic elements 90, 92 can be placed in series with the laces 68, 80, and the pyrotechnic elements 90, 92 can essentially break the laces in response to an electrical signal. In still further embodiments, a band structure 94 is adapted to fit around the sings 56, 58 to hold the wings 56, 58 in the stowed configuration when the winged body 50 is within the tube 100, wherein the band structure 94 is adapted to release the wings 56, 58 from the stowed configuration to the deployed configuration when the winged body 50 is removed from the tube 100, for example, in response to a drag of the band structure 94 through the water.

Figure 3:
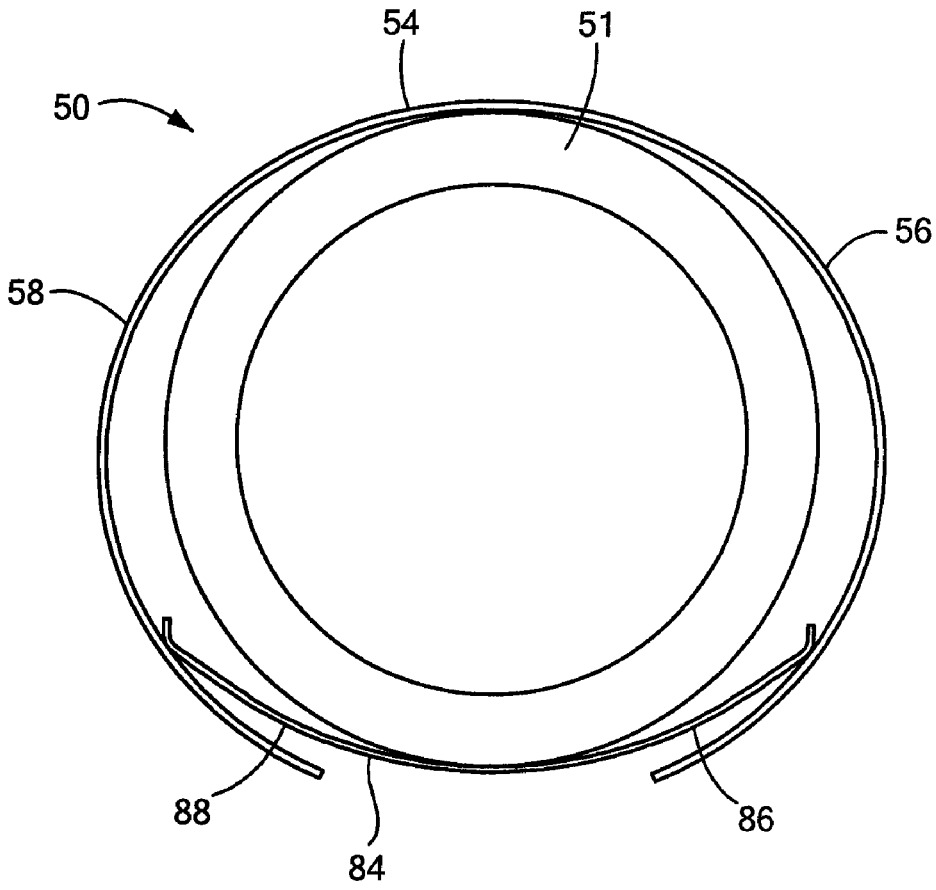
FIG. 3 is a pictorial showing a front view of the winged body of FIG. 1 in a stowed configuration.

Referring now to FIG. 3, in which like elements of FIG. 2 are shown having like reference designations, the winged body 50 from a front view shows the body structure 51, the wing structure 54, and the tail structure 84. It will be apparent that the wings 56, 58 can retain the tail structure 84 by contact therewith. In this view, the retention mechanism is not shown, e.g., the laces 68, 80 and features 62, 64, 74, 76 of FIG. 2.

Figure 4:
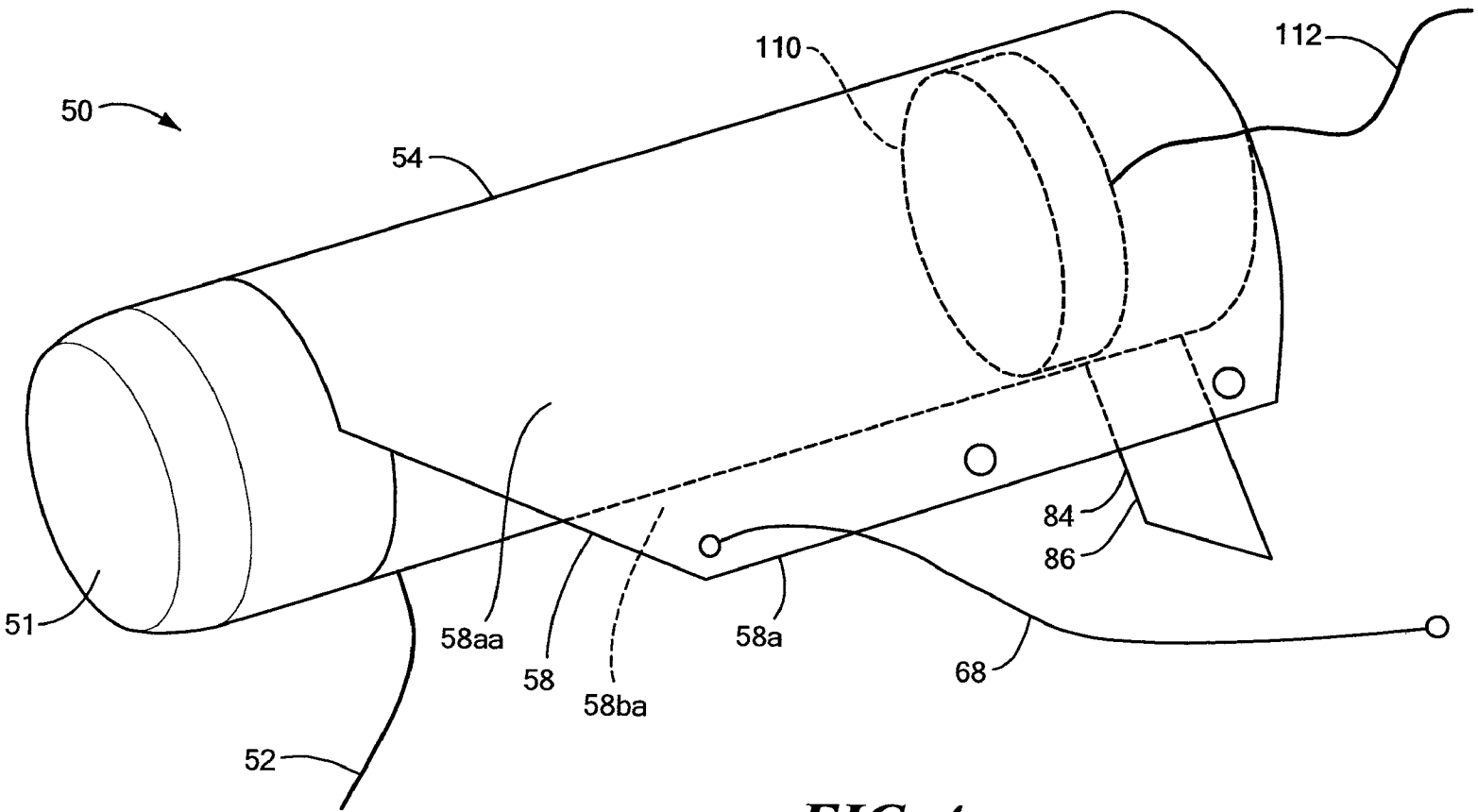
FIG. 4 is a perspective drawing showing the winged body of FIG. 1 in a deployed configuration.

Referring now to FIG. 4, the winged body 50 is shown in the deployed configuration, wherein the wings 56, 58 (only wing 58 shown) are released, causing them to spring to a deployed configuration, outward from the body structure 51.

The tail structure 84 also springs downward, apart from the body structure 51. The lace 68 no longer retains the wing 58. The wing 58 has a wing tip 58*a*.

A cable pack 110 can spool a communication link 112, for example, a wire or a fiber-optic cable, which spools off during deployment of the winged body 50. The communication link 112 can be the same as or similar to the fiber optic cable 26 of FIG. 1.

The wing 58 (and the other wing 56 not shown) can each have two substantially parallel major surfaces (e.g., 58*aa*, 58*ba*) and the winged body 50, when pulled though the water, can act like a kite to provide lift. However, in other arrangements, each one of the wings 56, 58 can have a relative surface contours between upper and lower surfaces so that it behaves Bernoulli's principle and acts like a true wing to provide the lift.

Figure 5:
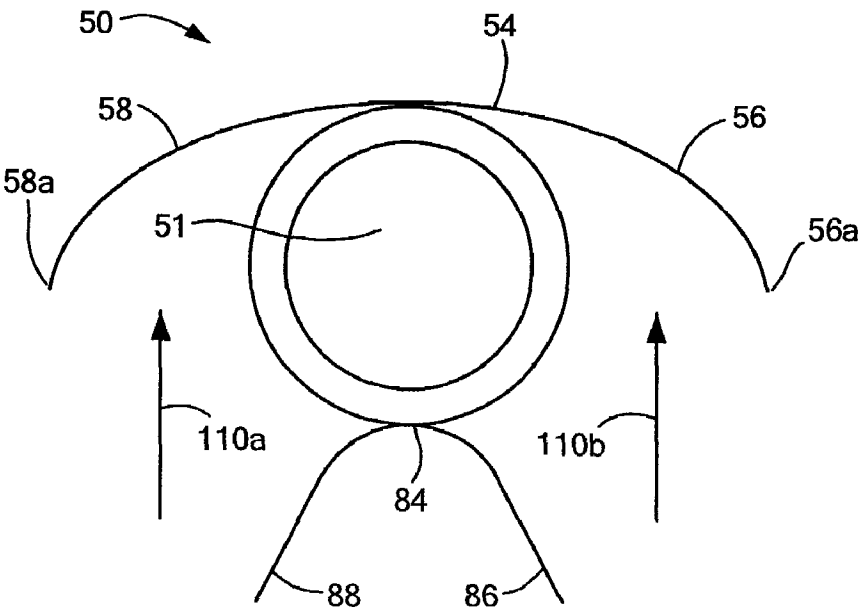
FIG. 5 is a pictorial showing a front view of the winged body of FIG. 1 in the deployed configuration.

Referring now to FIG. 5, in which like elements of FIG. 2 are shown having like reference designations, the winged body 50 is shown in the deployed configuration. The wing 56 has a wing tip 56*a* and the wing 58 has the wing tip 58*a*, which are separated from each other and from the body structure 51. The tail structure 84 has the tails 86, 88.

In the presence of a relatively low lift (depicted by arrows 110*a*, 110*b*) generated by the wings 56, 58, the wings 56, 58 have a shape indicative of the deployed configuration. While the wings 56, 58 in the deployed configuration are shown to have a downward curve, in other arrangements, the wings in the deployed configuration can be more straight, or can have a curve in the opposite direction.

The wings 56, 58 can provide a lift as a kite, wherein the winged body is towed through the water at an angle relative to the direction of travel. However, in other embodiments, the wings 56, 58 can have a contour that provides a lift by Bernoulli's principle, wherein one major surface of each wing, for example, an upper surface, has a surface contour resulting in a longer flow path along that surface than along the other major surface of each wing.

The tail structure 84 can operate to provide improved stability of the winged body 50 as it moves through the water. In particular, the tail structure can reduce at least one of a yaw or a roll of the winged body 50.

Figure 6:
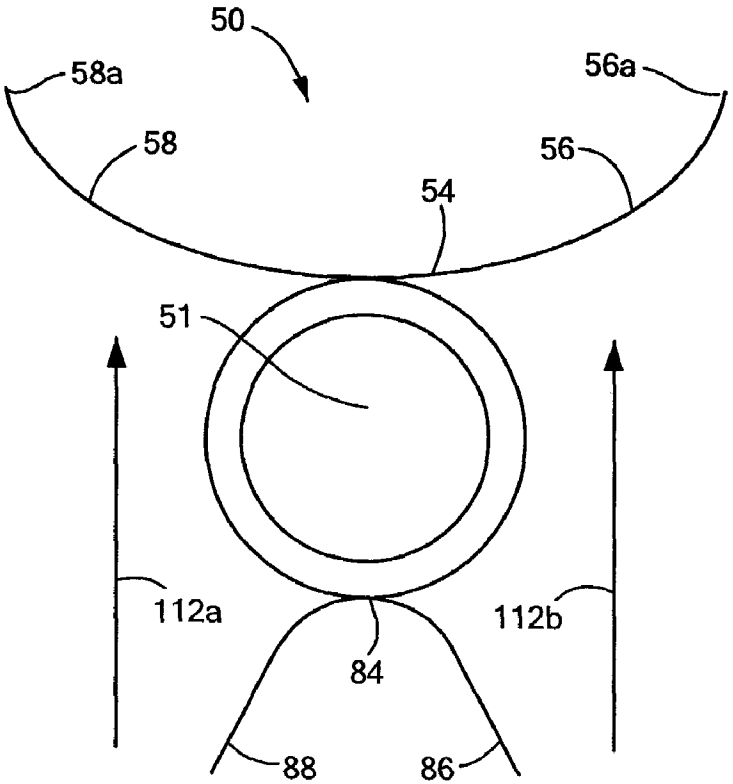
FIG. 6 is a pictorial showing a front view of the winged body of FIG. 1 in a deformed-deployed configuration.

Referring now to FIG. 6, in which like elements of FIG. 2 are shown having like reference designations, the wings 56, 58 are in a deformed-deployed configuration. In the presence of a relatively large lift (depicted by arrows 112*a*, 112*b*, which are longer than the arrows 110*a*, 110*b* of FIG. 5) generated by the wings 56, 58, the wings 56, 58 have a shape indicative of the deformed-deployed configuration. While the wings 56, 58 in the deformed-deployed configuration are shown to have an upward curvature, in other arrangements, the wings in the deformed-deployed configuration can be more straight, of can otherwise deform to reduce the lift from that which would result if the wings were in the deployed configuration of FIG. 5.

It should be appreciated that the wings 56, 58, which can be comprised of an elastically deformable material, can be retained in the stowed configuration of FIGS. 2, 2A, and 3, either by the tube 100 of FIG. 2A, or by a retention mechanism, for example the laces 60, 80 of FIG. 2. The wings 46, 58 can elastically move to the deployed configuration when the winged body 50 is removed from the tube 100, and maintain the wing shapes of FIG. 5 when moving (or when towed) though the water at a relatively slow speed. At higher speeds through the water, the wings can achieve the deformed-deployed configuration of FIG. 6.

In some arrangements, the deformed-deployed configuration of FIG. 6 is proportional. In other words, the wings deform from the deployed configuration of FIG. 5 by an amount proportional to a speed, for example a tow speed, of the winged body 50 through the water.

The deformed-deployed configuration can essentially reduce the lift upon the winged body 50 from that which would be achieved by the wings in the deployed configuration of FIG. 5. With this arrangement, at high speed through the water, the winged body does not apply undue stress or undue lift upon the tow cable 20 of FIG. 1 at higher tow speeds.

All references cited herein are hereby incorporated herein by reference in their entirety.

Having described preferred embodiments of the invention, it will now become apparent to one of ordinary skill in the art that other embodiments incorporating their concepts may be used. It is felt therefore that these embodiments should not be limited to disclosed embodiments, but rather should be limited only by the spirit and scope of the appended claims.

What is claimed is:

1. Winged body, comprising:

a body structure having a front end, a back end, a length, and a circumference;

a wing structure coupled to the body structure, wherein the wing structure is comprised of at least two wings, each wing having a respective wing tip, wherein the wings have a deployed configuration and a stowed configuration, wherein the wings are elastically deformable to the stowed configuration from the deployed configuration, wherein the wings are elastically releasable from the stowed configuration to the deployed configuration, wherein the wings in the deployed configuration have respective shapes selected to provide a lift upon the body structure when pulled though water, and wherein the wings in the stowed configuration have respective shapes selected to wrap generally around at least a portion of the circumference of the body structure;

a first communication cable coupled to the front end of the body structure, wherein the winged body is configured to be launched from a submarine, wherein the two wings are configured to automatically change from the stowed configuration to the deployed configuration upon launch to generate the lift, and wherein the lift of the winged body has a lift magnitude sufficient to pull the first communication cable upward; and a second communication cable in communication with the first communication cable and coupled to the back end of the body structure.

2. The winged body of claim 1, wherein the winged body is adapted to fit into a tube having an inner dimension, and wherein the wings are held in the stowed configuration within the inner dimension of the tube.

3. The winged body of claim 1, wherein the winged body is adapted to fit into a tube having an inner dimension, and wherein the wings are held in the stowed configuration by the inner dimension of the tube.

4. The winged body of claim 1, wherein the winged body further comprises a retention mechanism configured to hold the wings in the stowed configuration, wherein the retention mechanism is configured to release the wings from the stowed configuration to the deployed configuration.

5. The winged body of claim 4, wherein each one of the wings comprises a feature, and wherein the retention mechanism comprises a lace configured to hold the feature of each one of the wings at a predetermined relative separation, resulting in the wings being retained in the stowed configuration.

6. The winged body of claim 5, wherein the winged body is adapted to fit into a tube having an inner dimension, and wherein the lace is adapted to hold the wings in the stowed configuration when the winged body is within the tube, and wherein the lace is adapted to release the wings from the stowed configuration to the deployed configuration when the winged body is removed from the tube.

7. The winged body of claim 5, wherein the retention mechanism comprises a pyrotechnic mechanism coupled to the lace, wherein the pyrotechnic mechanism is configured to break the lace to release the wings from the stowed configuration to the deployed configuration when the winged body is removed from the tube.

8. The winged body of claim 4, further comprising a band structure adapted to fit around the wing structure to hold the wings in the stowed configuration when the winged body is within the tube, and wherein the band structure is adapted to release the wings from the stowed configuration to the deployed configuration when the winged body is removed from the tube, in response to a drag of the band structure through the water.

9. The winged body of claim 1, further comprising a tail structure coupled to the body structure, wherein tail structure has a deployed configuration and a stowed configuration, wherein the tail structure is elastically deformable to the stowed configuration from the deployed configuration, and wherein the tail structure is elastically releasable from the stowed configuration to the deployed configuration, wherein the tail structure in the deployed configuration has a shape selected to provide a stability to the body structure when pulled though water, and wherein the tail structure in the stowed configuration has a shape selected to wrap generally around at least a portion of the circumference of the body structure.

10. The winged body of claim 9, wherein the winged body is adapted to fit into a tube having an inner dimension, and wherein the tail structure is held in the stowed configuration within the inner dimension of the tube.

11. The winged body of claim 9, wherein the winged body is adapted to fit into a tube having an inner dimension, and wherein the wings are held in the stowed configuration by the inner dimension of the tube.

12. The winged body of claim 9, wherein the winged body further comprises a retention mechanism configured to hold the tail structure in the stowed configuration, wherein the retention mechanism is configured to release the tail structure from the stowed configuration to the deployed configuration.

13. The winged body of claim 9, wherein the each one of the wings has a predetermined stiffness that allows the each one of the wings to elastically deform from the deployed configuration to a deformed-deployed configuration in response to a drag of the wings when pulled through the water, resulting in a lift upon the body structure when pulled though water less than a lift when the wings are in the deployed configuration.

14. The winged body of claim 1, wherein each one of the wings has a predetermined stiffness that allows the each one of the wings to elastically deform from the deployed configuration to a deformed-deployed configuration in response to a drag of the wings when pulled through the water, resulting in a lift upon the body structure when pulled though water less than a lift when the wings are in the deployed configuration.

15. The winged body of claim 14, wherein, when in the deformed-deployed configuration, a shape of the each one of the wings changes in proportion to a speed with which the winged body is pulled through the water.

16. The winged body of claim 1, wherein each one of the wings has two respective substantially parallel major surfaces, and wherein the wings provide the lift when pulled through the water as a kite.

17. The winged body of claim 1, wherein each one of the wings has respective first and second major surfaces, wherein the wings provide the lift when pulled through the water by a achieving a first pressure upon the first major surface of each one of the wings and by achieving a second pressure lower than the first pressure upon the second major surface of each one of the wings.

18. The winged body of claim 17, wherein the first and second major surfaces of the wing have different surface contours.

19. The winged body of claim 1, further comprising a cable pack coupled to the body structure, wherein the cable pack has an optical fiber wound therein.

20. The winged body of claim 6, wherein the lace comprises a ball feature at an end thereof, and wherein at least one of the wings comprises a hole feature configured to accept the ball feature and to retain the ball feature when the winged body is in the stowed configuration within the tube and to automatically release the ball feature when the winged body is deployed from the tube.

21. Winded body, comprising:

a body structure having a length and a circumference;

a wing structure coupled to the body structure, wherein the wing structure is comprised of at least two wings, each wing having a respective wing tip, wherein the wings have a deployed configuration and a stowed configuration, wherein the wings are elastically deformable to the stowed configuration from the deployed configuration, wherein the wings are elastically releasable from the stowed configuration to the deployed configuration, wherein the wings in the deployed configuration have respective shapes selected to provide a lift upon the body structure when pulled though water, and wherein the wings in the stowed configuration have respective shapes selected to warp generally around at least a portion of the circumference of the body structure;

a retention mechanism configured to hold the wings in the stowed configuration, wherein the retention mechanism is further configured to release the wings from the stowed configuration to the deployed configuration, wherein each one of the wings comprises a feature, and wherein the retention mechanism comprises a lace configured to hold the feature of each one of the wings at a predetermined relative separation, resulting in the wings being retained in the stowed configuration, wherein the lace is configured to hold the wings in the stowed configuration when the winged body is within a tube, and wherein the lace is configured to release the wings from the stowed configuration to the deployed configuration when the winged body is removed from the tube; and a tail structure coupled to the body structure, wherein the tail structure has a deployed configuration and a stowed configuration, wherein the tail structure is elastically deformable to the stowed configuration from the deployed configuration, and wherein the tail structure is elastically releasable from the stowed configuration to the deployed configuration, wherein the tail structure in the deployed configuration has a shape selected to provide a stability to the body structure when pulled though water, and wherein the tail structure in the stowed configuration has a shape selected to wrap generally around at least a portion of the circumference of the body structure.

22. The winged body of claim 21, wherein the each one of the wings has a predetermined stiffness that allows the each one of the wings to elastically deform from the deployed configuration to a deformed-deployed configuration in response to a drag of the wings when pulled through the water, resulting in a lift upon the body structure when pulled though water less than a lift achieved when the wings are in the deployed configuration.

23. The winged body of claim 21, wherein the lace comprises a ball feature at an end thereof, and wherein at least one of the wings comprises a hole feature configured to accept the ball feature and to retain the ball feature when the winged body is in the stowed configuration within the tube and to automatically release the ball feature when the winged body is deployed from the tube.

* * * * *